US009607592B2

(12) United States Patent
Chen

(10) Patent No.: US 9,607,592 B2
(45) Date of Patent: Mar. 28, 2017

(54) GUITAR HANGER APPARATUS

(71) Applicant: Aroma Music Co., Ltd., Shenzhen (CN)

(72) Inventor: Haihua Chen, Shenzhen (CN)

(73) Assignee: AROMA MUSIC CO., LTD., Shenzhen (CN)

( * ) Notice: Subject to any disclaimer, the term of this patent is extended or adjusted under 35 U.S.C. 154(b) by 3 days.

(21) Appl. No.: 14/962,349

(22) Filed: Dec. 8, 2015

(65) Prior Publication Data

US 2016/0335994 A1 Nov. 17, 2016

(30) Foreign Application Priority Data

May 11, 2015 (CN) ..... 2015-20298764

(51) Int. Cl.
*G10G 5/00* (2006.01)

(52) U.S. Cl.
CPC ..... *G10G 5/00* (2013.01)

(58) Field of Classification Search
CPC G10G 5/00; G10G 5/005; G10G 7/00; G10G 7/005; G10G 7/02; G10D 13/026; G10D 1/085; G10D 3/00; G10D 13/06; G10D 1/08; G10D 3/18; G10D 13/00; G10D 3/003; G10D 3/163; G10D 13/065; G10D 3/02
USPC .... 248/304, 305, 339, 340; 84/327; 211/113
See application file for complete search history.

(56) References Cited

U.S. PATENT DOCUMENTS

| | | | | |
|---|---|---|---|---|
| 6,281,417 | B1 * | 8/2001 | Ladao | G10G 5/00 211/85.6 |
| 6,513,768 | B1 * | 2/2003 | Hsieh | F16M 11/02 248/121 |
| 7,484,701 | B2 * | 2/2009 | Hsieh | A47F 5/0853 211/106.01 |
| 7,579,537 | B2 * | 8/2009 | Lippert | G10G 5/00 84/327 |
| 7,906,717 | B2 * | 3/2011 | Wang | G10G 5/00 248/121 |
| 8,763,961 | B1 * | 7/2014 | Yang | G10G 5/00 248/122.1 |
| 2008/0168883 | A1 * | 7/2008 | Chen | G10G 5/00 84/327 |

* cited by examiner

*Primary Examiner* — Steven Marsh
(74) *Attorney, Agent, or Firm* — Anova Law Group, PLLC

(57) ABSTRACT

The present invention discloses a guitar hanger apparatus, including a fixed base and a hanger body fixedly connects to the fixed base; the fixed hanger body further includes a fixing holder, applied to support the guitar and move down following the weight of the guitar, a self-locking mechanism connecting to and driven by the fixing holder; the self-locking mechanism comprises rotating shaft assemblies, built in the main body of the hanger, and swing arms connecting to the rotating shaft assemblies; the fixed holder comprises positioning casts, applied to fix the guitar, while a driving unit is arranged in the positioning cast, applied to drive the rotating shaft assemblies. The present invention achieves fixation and protection to a guitar by the weight of the guitar, which has a simple structure, and enables mass production thus brings benefits to the manufacturer.

12 Claims, 9 Drawing Sheets

GUITAR HANGER APPARATUS

CROSS-REFERENCES TO RELATED APPLICATIONS

This application claims the priority of Chinese patent application no. 201520298764.3, filed on May 11, 2015, the entire contents of all of which are incorporated herein by reference.

FIELD OF THE INVENTION

The present invention relates to a hanger apparatus, more particularly, to a guitar hanger apparatus.

BACKGROUND

Hangers for musical instruments are applied to shelve and store those musical instruments, including guitar and else. Most of the hangers for musical instruments currently in the market are of fixed fork structures. When these hangers are in use, in the cases of not placing correctly or being touched by external forces, the musical instruments are easy to slip out of the folks and dump, or, even fall and damages could happen, which has brought inconveniences in using.

Therefore, in the market, there is a kind of guitar hanger, after hanging a guitar on it, its lock arms may rotate, driven by the body weight of the guitar, then the hanger opening may get closed for protections, thus avoiding the problems of displacements or fall, due to placing the guitar not in place or careless collisions to the guitar.

Given to the presented background above, a newly designed guitar hanger structure, different to all the guitar hangers currently in the market, is described in the present disclosure, which can achieve the same protections to musical instruments with a simpler structure, also, it is more convenient for installations.

Therefore, the prior art needs to be improved and developed.

BRIEF SUMMARY OF THE DISCLOSURE

The technical problem to be solved in the present invention is, aiming at the defects of the prior art, providing a guitar hanger apparatus, which is able to fix a guitar firmly by the weight of the guitar, thus avoid damages to the guitar, in order to solve the problems in the prior art.

The technical solution of the present invention to solve the technical problems is as follows.

One aspect of the present disclosure provides a guitar hanger apparatus, including a fixed base and a hanger body fixedly connects to the fixed base.

The hanger body further includes a fixing holder, applied to support the guitar and move down following the weight of the guitar, and a self-locking mechanism, connecting to and driven by the fixing holder.

The self-locking mechanism includes rotating shaft assemblies, built in the main body of the hanger, and swing arms connecting with the rotating shaft assemblies.

The fixing holder includes positioning casts, applied to fix the guitar. A driving unit is arranged in each of the positioning casts, applied to drive the rotating shaft assemblies.

The fixing holder includes two positioning casts, while the positioning cast is composed by two positioning units connecting fixedly.

The positioning cast contains a guiding column, applied to guide directions. A compression spring is set in the positioning cast.

Both of the positioning casts connect to the two branches of a Y-shaped folk in the hanger body through the compression springs respectively; each branch of the Y-shaped folk contains a round groove, applied to connect the compression spring; both sides of each branch of the Y-shaped folk also contain guiding grooves, adapting to the guiding columns.

The rotating shaft assembly includes a rotating shaft. A stressed unit adapting to the driving unit is arranged in the rotating shaft. The stressed unit connects to the hanger body through a positioning plastic cover.

The driving unit is a rectangular block with open grooves, and the stressed unit is a U-shaped projection block.

The stressed unit is arranged on a reset disk in the rotating shaft assembly; the reset disk includes a position limiter, and a reset block set on the position limiter.

The driving unit is a rack with teeth, and the corresponding stressed unit is of a gear structure.

The fixing holder further comprises a silicon jacket arranged in the positioning cast, the silicon jacket contains a dent to hold the guitar; the end of the silicon jacket further contains a rubber pad.

A column-shaped fixing sleeve is arranged in the fixed base, a fixing column is arranged at one end of the hanger body, both the fixing column and the fixing sleeve are connected by a screw.

Inside the two branches of the Y-shaped folk in the hanger body, a protective pad is arranged to protect the guitar.

The present invention provides a guitar hanger apparatus, due to adopting a fixing holder to support the guitar and being able to move down following the weight of the guitar, achieves the fixation and protection to a guitar by the weight of the guitar, having a simple structure, enabling mass production and bringing benefits to the manufacturer.

Figure labels: 1. Right swing arm; 2. Left swing arm; 3. EVA mat; 4. Screw; 5. Rubber pad; 6. Silicon jacket; 7. rotating shaft assemblies; 8. Plastic cover; 9. Y-shaped Folk; 10. Dent; 11. Left positioning unit; 12. Right positioning unit; 13. Compression spring; 14. Protective pad; 15. Hanger body; 16. Self-tapping screw; 17. Fixed base; 18. Limiting screw; 19. Bottom cast; 20. Guiding column; 21. Round groove; 22. Guiding groove; 23. Fixing holder; 24. Self-locking mechanism; 25. Fixing sleeve; 26. Fixing column; 27. Driving unit; 28. Stressed unit; 29. Positioning cast; 30. Guitar; 71. rotating shaft; 72. U-shaped projection block; 73. Reset block; 74. Position limiter.

DETAILED DESCRIPTION

The present invention provides a guitar hanger apparatus. In order to make the purpose, technical solution and the advantages of the present invention clearer and more explicit, further detailed descriptions of the present invention are stated here, referring to the attached drawings and some embodiments of the present invention. It should be understood that the detailed embodiments of the invention described here are used to explain the present invention only, instead of limiting the present invention.

Figure 1:
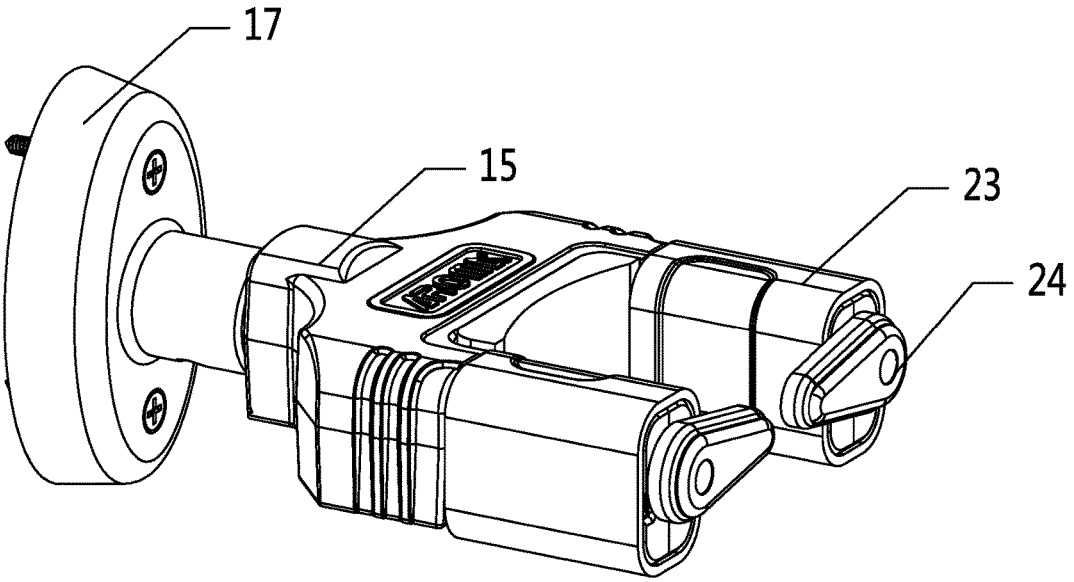
FIG. 1 illustrates a perspective view of a preferred embodiment for the guitar hanger apparatus provided in the present invention.
Figure 2:
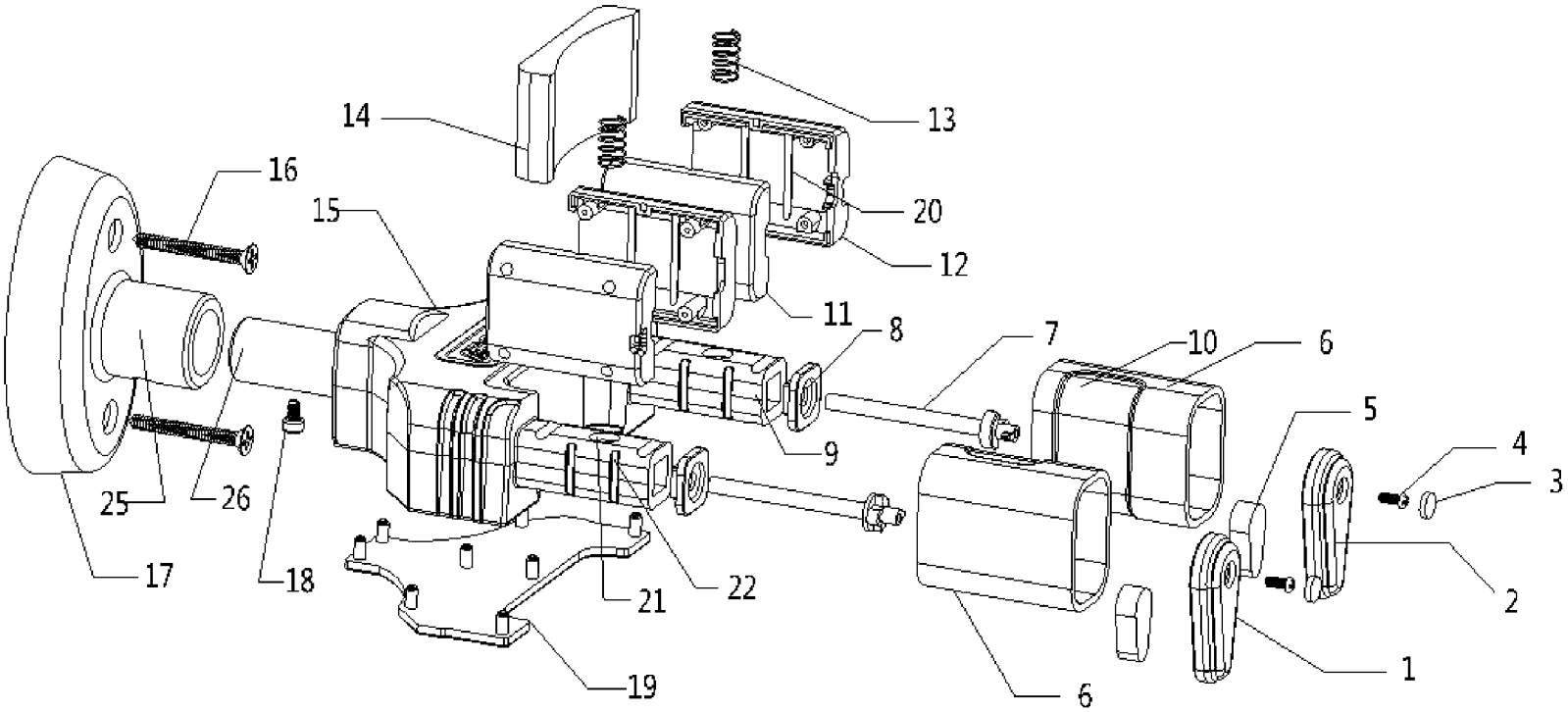
FIG. 2 illustrates an exploded diagram of a preferred embodiment for the guitar hanger apparatus provided in the present invention.

Referencing to FIG. 1 and FIG. 2, the guitar hanger apparatus provided in the present invention, includes a fixed base 17, and a hanger body 15, fixedly connecting to the fixed base 17. The fixed base 17 is fixed on a wall by a self-tapping screw 16, then, the hanger body 15 is fixedly connected to the fixed base 17. Specifically, a column shaped fixing sleeve 25 is arranged in the fixed base, which has holes and grooves, then, a fixing column 26 is arranged at one end of the hanger body 15, and the fixing column 26 is arranged in the holes and grooves of the fixing sleeve 25, both the fixing column 26 and the fixing sleeve 25 are connected by a limiting screw 18. The fixed base 17 and the hanger body 15 acts together to support the weight of the guitar.

The hanger body 15 further includes a fixing holder 23, which is applied to support the guitar and move down following the weight of the guitar, and a self-locking mechanism 24, connecting to the fixing holder 23 while driven by the fixing holder 23. That is, the fixing holder 23 flexibly connects to the hanger body 15, the fixing holder 23 may move down along the hanger body 15 under the weight of the guitar or in supporting the guitar. When the outer force is removed, the fixing holder 23 may move upward and start to reset. The self-locking mechanism 24 may rotate or move driven by the fixing holder 23, while the fixing holder 23 moves down. Also, at the same time as the self-locking mechanism 24 rotates or moves, the guitar placed on the fixing holder 23 is locked. The lock may mean fixing the guitar or mean covering the fixing holder 23 to avoid the guitar slipping out from the fixing holder 23.

Figure 10:
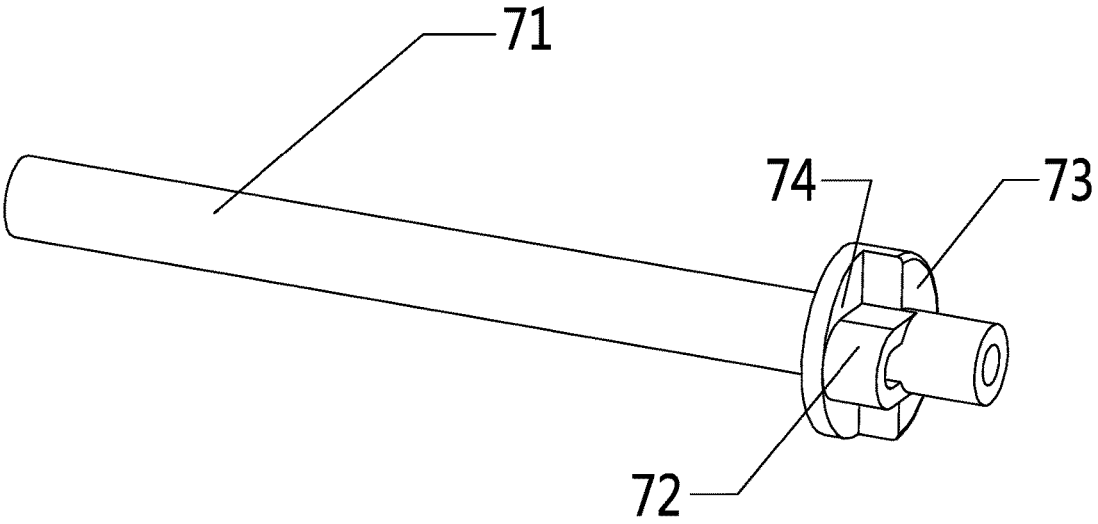
FIG. 10 illustrates a structure diagram of rotating shaft assemblies in a preferred embodiment for the guitar hanger apparatus provided in the present invention.
Figure 11:
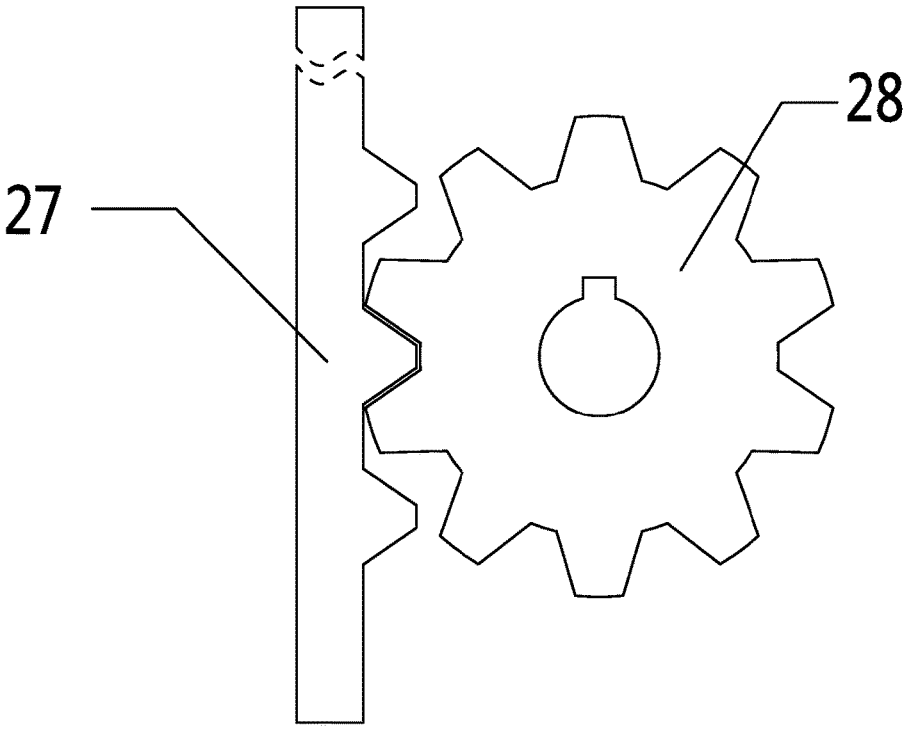
FIG. 11 illustrates a structure diagram of another rotating shaft assemblies in a preferred embodiment for the guitar hanger apparatus provided in the present invention.

Specifically, as shown in FIG. 2, the self-locking mechanism 24 includes rotating shaft assemblies 7, built in the main body of the hanger 15, and swing arms (left and right swing arms) connecting with the rotating shaft assemblies 7 (left and right rotating shaft assemblies). Shown as FIG. 10, a rotating shaft assembly 7 includes a rotating shaft 71, a position limiter 74, applied to make the rotation shaft 71 rotates uniformly in the hanger body 15, the position limiter 74 is a round shaped board piece, whose upper side is cut and a half round shaped block is removed, thus a half round platform is formed, which is the reset block 73. A stressed unit 28 is set next to the reset block 73, the stressed unit 28 is a U-shaped projection block 72. The fixing holder 23 may drive the stressed unit 28 and make the rotation shaft assembly 71 move or rotate.

As an embodiment of the present invention, a driving unit 27 may be a rectangular block with open grooves, and the corresponding stressed unit 28 is a U-shaped projection block; or, the driving unit 27 may be a rack with teeth, and the corresponding stressed unit 28 is a gear structure. When the stressed unit 28 is a gear structure, the above said reset block 73 may be neglected.

Figure 4:
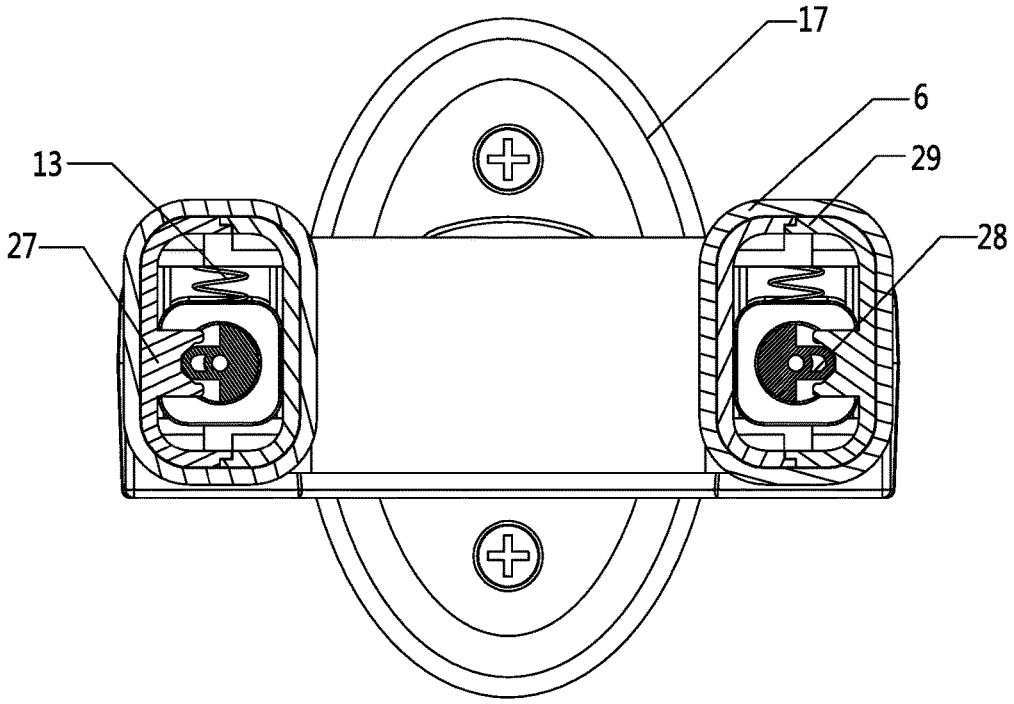
FIG. 4 illustrates a cutaway view of FIG. 3.

Back to FIG. 2, and combining FIG. 4, the fixing holder 23 comprises positioning casts 29, applied to fix the guitar; and a driving unit 27 is arranged in the positioning casts, applied to drive the rotating shaft assembly 7 rotate. Accordingly, the rotating shaft assembly 7 contains a stressed unit 28, adapting to the driving unit 27. Wherein, the fixing holder 23 comprises two positioning casts 29, while the positioning cast 29 is composed by two positioning units connecting fixedly, therefore, there are totally 4 positioning units in the present invention. That is, the left positioning unit 11 and the right positioning unit 12 as in FIG. 2 (however, only two of them are marked in the figure, while the other two are located in the relative positions of both left and right positioning units). Preferably, the driving unit 27 is a rectangular block with grooves, the stressed unit 28 is a U-shaped projection block. The driving unit 27 is a rack with teeth, and the stressed unit 28 is a gear structure.

Further, as shown in FIG. 2, each positioning cast 29 contains a compression spring 13. The compression spring 13 is arranged on a projection part in the positioning cast 29, whose bottom connects to the Y-shaped folk 9 in the hanger body 15. The fixing holder 23 achieves position reset by the compression spring 13.

Figure 3:
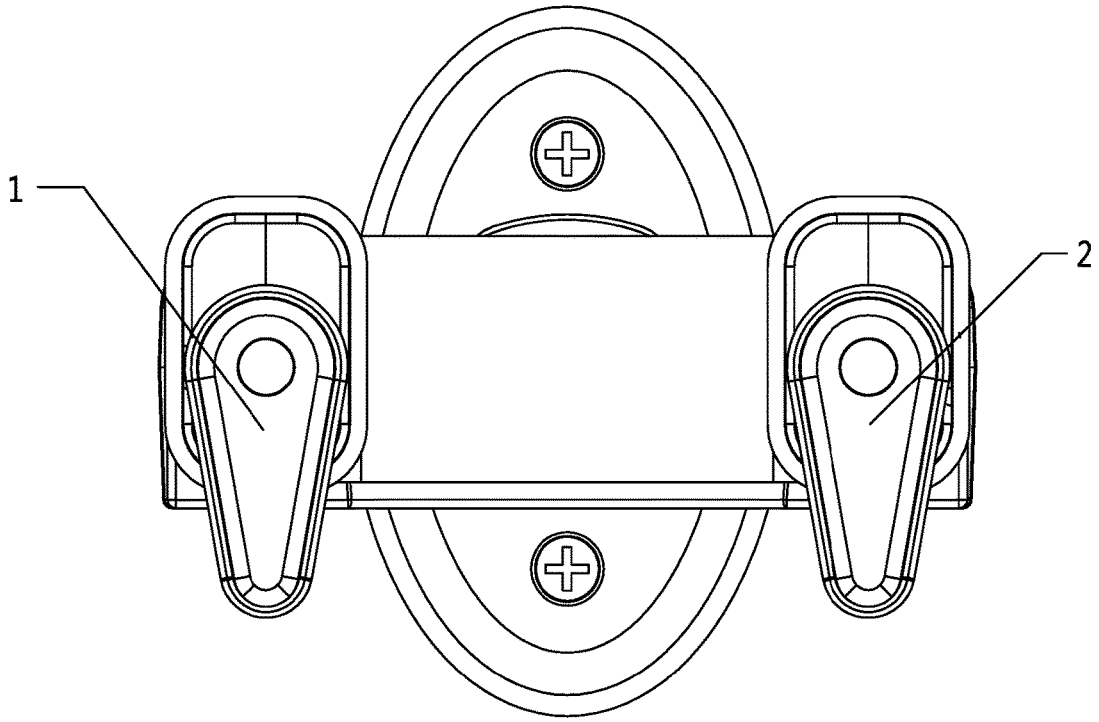
FIG. 3 illustrates an opened status reference diagram of a preferred embodiment for the guitar hanger apparatus provided in the present invention.

Take the fixing holder 23 driving the self-locking mechanism 24 rotating to accomplish locking the guitar as an example, shown as FIG. 3 and FIG. 4, wherein, FIG. 3 illustrates an opened status reference diagram of a preferred embodiment for the guitar hanger apparatus provided in the present invention, and FIG. 4 is a cutaway view of FIG. 3. That is, before the present embodiment start working, the fan-shaped swing arms of the self-locking mechanism 24 are dropping vertically, and the fixing holder 23 is in its original position under the support of the compression spring 13. That is, before any displacements, the driving unit 27 engages the stressed unit 28. When hanging a guitar to the fixing holder 23, the weight of the guitar acts on the fixing holder 23, that causes that the compression spring 13 is compressed, and the fixing holder 23 moves down. During the driving unit 27 moving down, the stressed unit 28 is driven to rotate, and the rotation of the stressed unit 28 also drives the rotation of the rotation shaft 71 and the swing arms. The present invention includes a left swing arm 2 and a right swing arm 1; wherein, each of both left and right swing arms has a through-hole, and both left and right swing arms connect to one end of each rotating shaft 71, fixed with a screw 4. An EVA mat 3 (composite rubber mat) is applied into each through-hole to cover and protect the screw 4, while also increasing the beauty of appearance.

Figure 5:
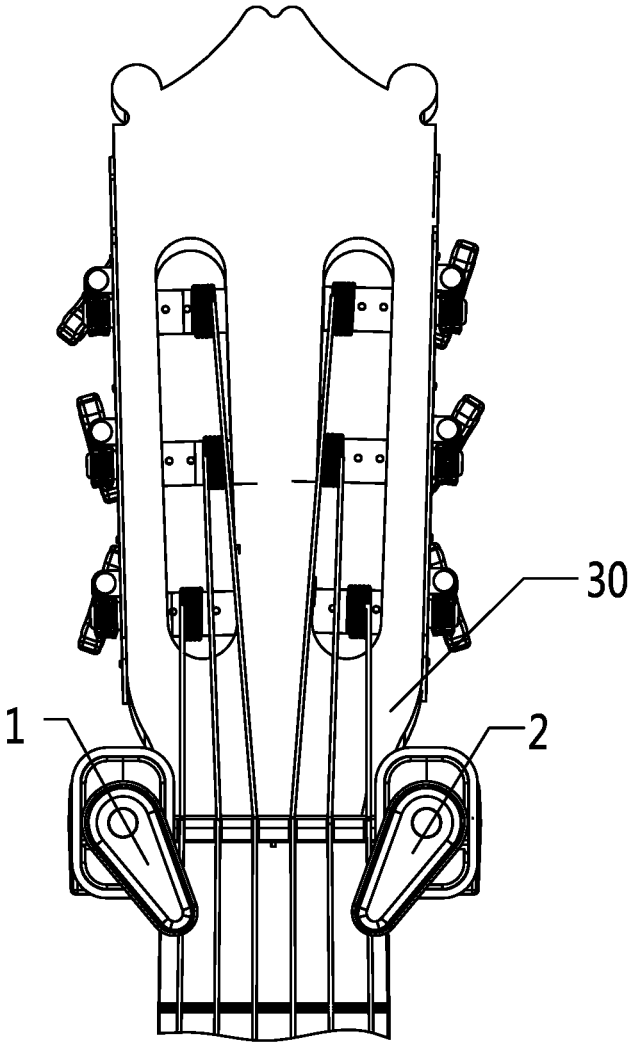
FIG. 5 illustrates a half-opened status reference diagram of a preferred embodiment for the guitar hanger apparatus provided in the present invention.
Figure 6:
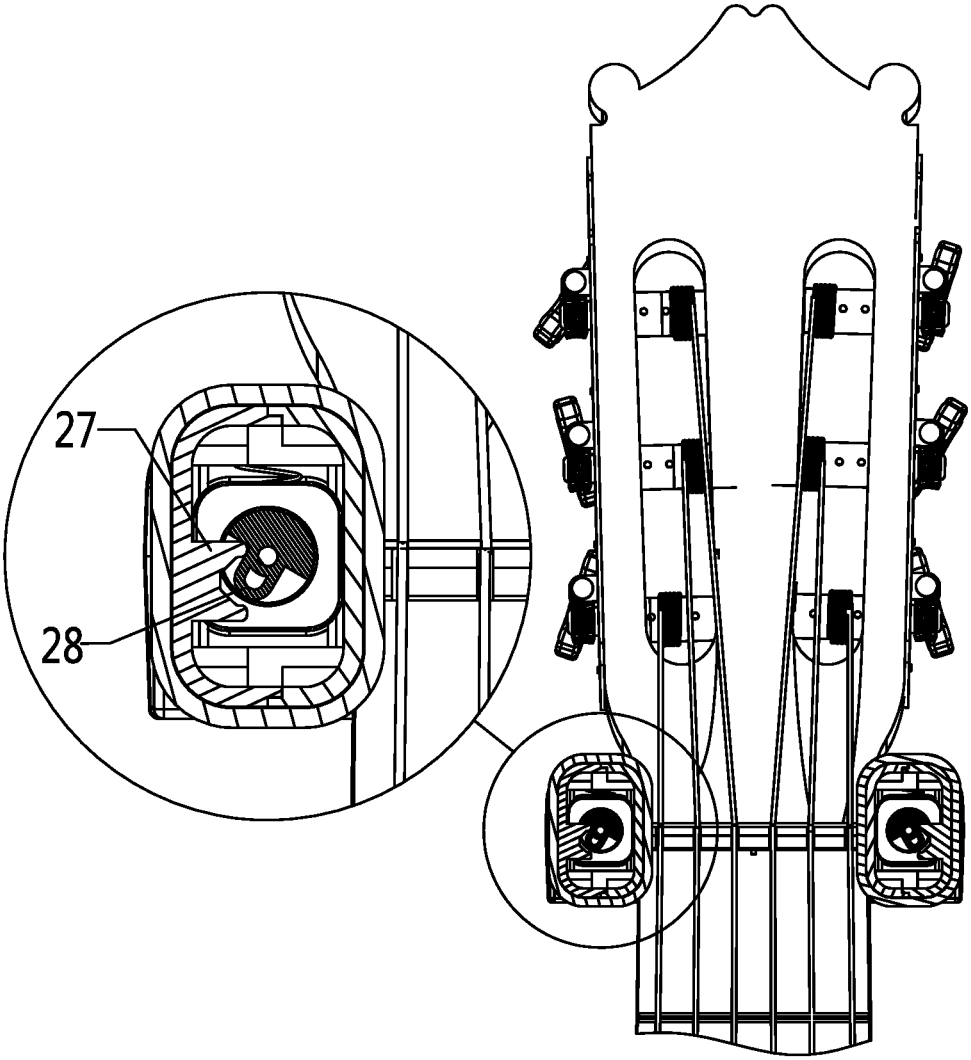
FIG. 6 illustrates a cutaway view of FIG. 5.
Figure 7:
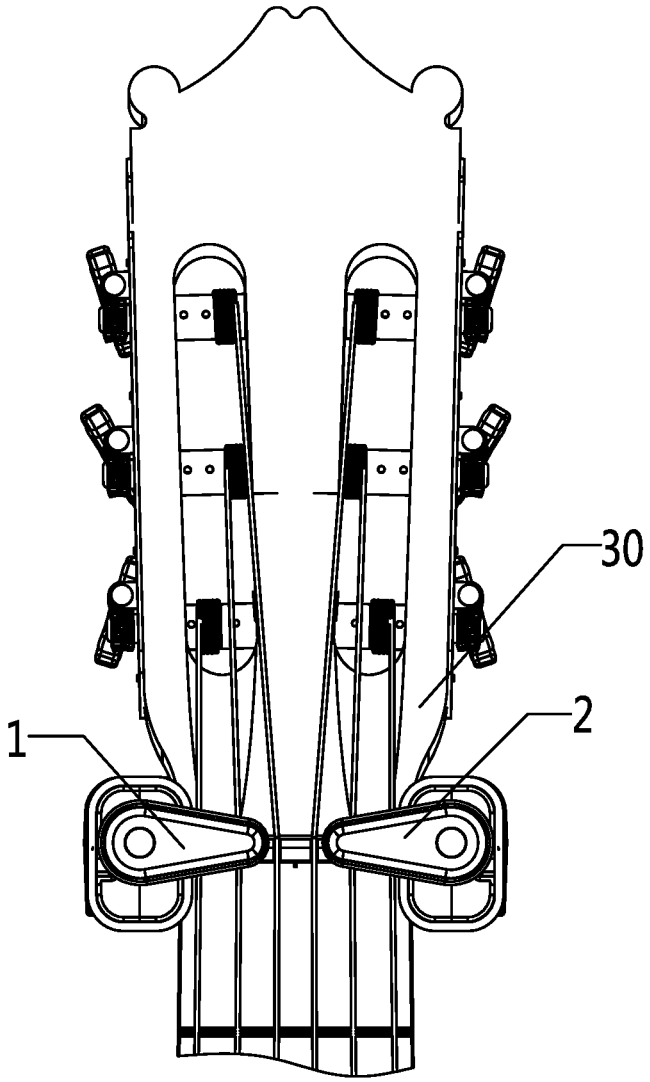
FIG. 7 illustrates a closed status reference diagram of a preferred embodiment for the guitar hanger apparatus provided in the present invention.
Figure 8:
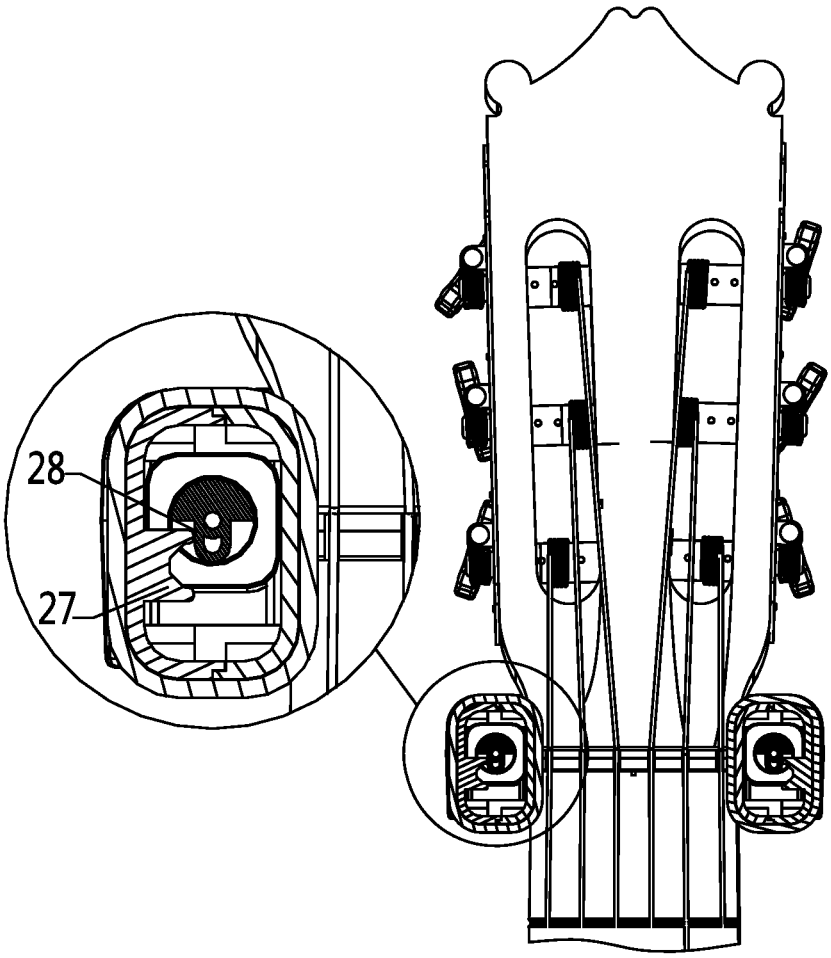
FIG. 8 illustrates a cutaway view of FIG. 7.
Figure 9:
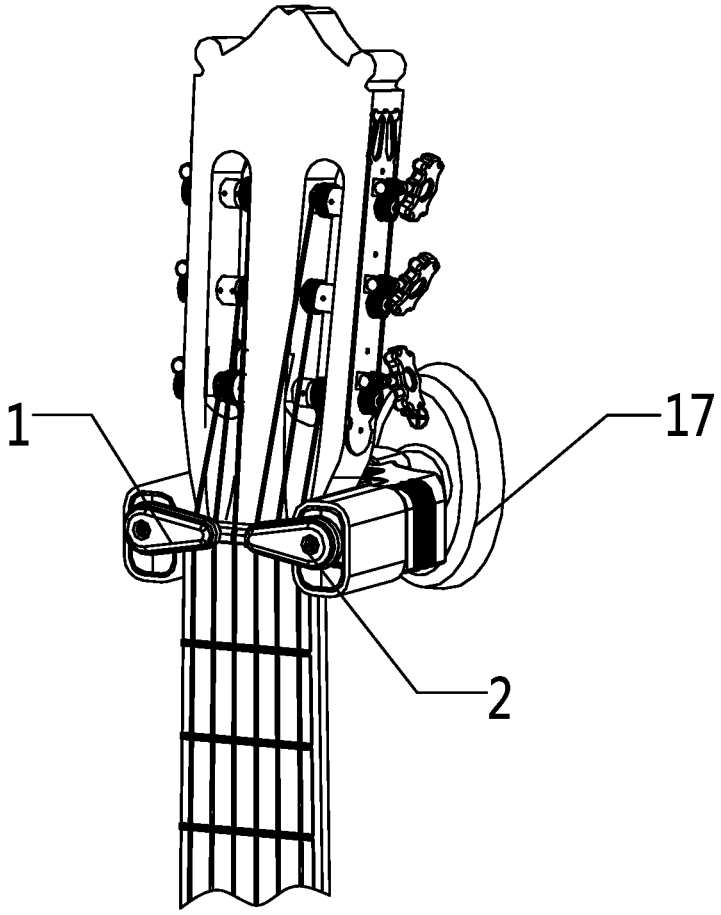
FIG. 9 illustrates a using state reference diagram of a preferred embodiment for the guitar hanger apparatus provided in the present invention.

The two swing arms in the present invention form a holding arm structure by one rotating clockwise and the other rotating counter-clockwise, details are shown in FIG. 5 and FIG. 6. Resuming to FIG. 7 and FIG. 8, wherein, FIG. 7 illustrates a closed status reference diagram of a preferred embodiment for the guitar hanger apparatus provided in the present invention, and FIG. 8 is a cutaway view of FIG. 7. When the fixing holder 23 stops moving down, the stressed unit 28 turns 90°, and both swing arms also turn 90°, now the two swing arms form a holding arm structure, and accomplishes the self-locking of the self-lock mechanism 24, which fixes the guitar inside the fixing holder 23, making it not easy to slip out. Details are shown in FIG. 9.

It should be noted that, the stressed unit 28 is arranged on a reset disk in the rotating shaft assemblies 7; the reset disk includes a position limiter 74, and a reset block 73 set on the position limiter 74. When removing the guitar, the compression spring 13 returns, and drives the driving unit 27 (i.e., the rectangular block with grooves) moving up, during the process of the driving unit 27 moving up. Since the driving unit 27 touchingly connects to the reset block 73, shown as FIG. 6, the side of the driving unit 27 abuts the half circle side of the reset block 73, and drives the reset block 73 rotating inversely (i.e., inverse to the self-locking direction). After the compression spring 13 returns, the driving unit 27 stops moving, and the reset block 73 turns to its original position, that accomplishes the reset action of the self-locking mechanism.

Further, shown as FIG. 2, two rectangular branches of the Y-shaped folk 9 are arranged in the front end of the hanger body 15, as described in the present invention. Each branch of the Y-shaped folk 9 comprises a hole-like structure. In the above described embodiment, each positioning cast 29 connects to a branch of the Y-shaped folk 9 in the hanger body 15 through the compression spring 13 respectively. The Y-shaped folk 9 is applied as a supporting part for the above said positioning cast 29, and withstands the weight of the guitar. Each branch of the Y-shaped folk 9 contains a round groove 21, applied to connect the compression spring 13. That is, interconnecting the positioning cast 29 and the hanger body 15 as described in the present invention through the compression spring 13. Each positioning cast 29 contains a guiding column 20 inside, to guide the positioning cast 29 correspondingly. Both branches of the Y-shaped folk 9 further contain guiding grooves 22, adapting to the guiding columns 20. During the possesses of the positioning casts 29 moving down and returning, the guiding columns 20 move following the guiding grooves 22, thus ensure the smooth running of the positioning casts 29.

Continuing with FIG. 2, the rotating shaft assembly 7 contains a stressed unit 28, adapting to the driving unit 27. The stressed unit 28 connects to the hanger body 15 through a positioning plastic cover 8. The positioning plastic cover 8 contains grooves, making the position limiter 74 in the rotating shaft assembly 7 rotate smoothly in the positioning plastic cover 8. The fixing holder 23 further comprises a silicon jacket 6 arranged in the positioning cast 29. The silicon jacket 6 contains a dent 10 to hold the guitar. The dent 10 may fix the guitar and make it not easy to move. The end of the silicon jacket 6 further contains a rubber pad 5, the rubber pad 5 may adopt the EVA mat 3.

In the guitar hanger apparatus, the bottom of the hanger body 15 further contains a bottom cast 19 between the two branches of the Y-shaped folk 9 in the hanger body 15. A protective pad 14 is arranged to protect the guitar (an EVA mat 3 may be adopted). Preferably, two curved grooves may be arranged in the Y-shaped folk 9, applied to adapt the screw paths in the positioning cast 29, so as to allow the positioning cast 29 move down further.

In summary, the guitar hanger apparatus provided in the present invention, due to adopting a fixing holder, which is applied to support the guitar and move down following the weight of the guitar, and a self-locking mechanism, connecting to and driven by the fixing holder, when hanging the guitar onto the hanger apparatus, the self-weight of the guitar acts on the fixing holder, and during the fixing holder moving down, the self-locking mechanism is driven to work, and when the fixing holder stops moving, the two swing arms of the self-locking mechanism stop rotating and compose a holding arm structure to protect the guitar; when removing the guitar, the fixing holder returns and drives the self-locking mechanism returning. The present invention achieves the fixation and protection to a guitar by the self-weight of the guitar, having a simple structure, enabling mass production and bringing benefits to the manufacturer.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. A guitar hanger apparatus, comprises:

a fixed base and a hanger body fixedly connects to the fixed base;

wherein:

the hanger body further includes: a fixing holder applied to support the guitar and move down following a weight of the guitar, and a self-locking mechanism connecting to and driven by the fixing holder;

the self-locking mechanism includes: rotating shaft assemblies built in a main body of the hanger, and swing arms connecting with the rotating shaft assemblies;

the fixing holder comprises two positioning casts applied to fix the guitar, wherein a driving unit is arranged in each of the positioning casts, and is applied to drive the rotating shaft assemblies, each of the positioning casts contains a compression spring.

2. A guitar hanger apparatus, comprising:

a fixed base and a hanger body fixedly connects to the fixed base;

wherein:

the hanger body further includes: a fixing holder applied to support the guitar and move down following a weight of the guitar, and a self-locking mechanism connecting to and driven by the fixing holder;

the self-locking mechanism includes: rotating shaft assemblies built in a main body of the hanger, and swing arms connecting with the rotating shaft assemblies;

the fixing holder comprises positioning casts applied to fix the guitar, wherein a driving unit is arranged in each of the positioning casts, and is applied to drive the rotating shaft assemblies;

the fixing holder includes two positioning casts, wherein each of the positioning cast is composed by two positioning units connecting fixedly; and each of the positioning cast contains: a guiding column applied to guide directions, and a compression spring.

3. The guitar hanger apparatus according to claim 2, wherein, both of the positioning casts connect to two branches of a Y-shaped folk in the hanger body through the compression springs respectively; each branch of the Y-shaped folk contains a round groove, applied to connect the compression spring; and both branches of the Y-shaped folk further contain guiding grooves, adapting to the guiding columns.

4. The guitar hanger apparatus according to claim 2, wherein, the rotating shaft assembly includes a rotating shaft, a stressed unit adapting to the driving unit is arranged in the rotating shaft, and the stressed unit connects to the hanger body through a positioning plastic cover.

5. The guitar hanger apparatus according to claim 4, wherein, the driving unit is a rectangular block with open grooves, and the stressed unit is a U-shaped projection block.

6. The guitar hanger apparatus according to claim 5, wherein, the stressed unit is arranged on a reset disk in the rotating shaft assembly; and the reset disk includes a position limiter, and a reset block set on the position limiter.

7. The guitar hanger apparatus according to claim 4, wherein, the driving unit is a rack with teeth, and the stressed unit is a gear structure.

8. The guitar hanger apparatus according to claim 2, wherein, the fixing holder further comprises a silicon jacket arranged in the positioning cast; the silicon jacket contains a dent to hold the guitar; and an end of the silicon jacket further contains a rubber pad.

9. The guitar hanger apparatus according to claim 2, wherein, a column-shaped fixing sleeve is arranged in the fixed base, a fixing column is arranged at one end of the hanger body, the fixing column and the fixing sleeve are connected by a screw.

10. The guitar hanger apparatus according to claim 3, wherein, inside the two branches of the Y-shaped folk in the hanger body, a protective pad is arranged to protect the guitar.

11. A guitar hanger apparatus, comprising:

a fixing holder applied to support a guitar, and a self-locking mechanism connecting to and driven by the fixing holder;

the self-locking mechanism includes at least two rotating shaft assemblies and at least two swing arms, wherein each rotating shaft assembly is connected with one rotating shaft assemblies;

the fixing holder includes at least two driving units and at least two stressed units, wherein each stress unit engages with one corresponding driving unit;

when the fixing holder moves from an upper position to a lower position following a weight of the guitar, each driving unit forces one corresponding stressed unit rotates from a horizontal position to a vertical position, and the one stressed unit drives one corresponding swing arm from an open position to a lock position via one corresponding rotating shaft assembly.

12. The guitar hanger apparatus of claim 11, wherein:

the fixing holder further includes at least two positioning casts, wherein each of the positioning cast is composed by two positioning units connecting fixedly; and each of the positioning cast contains: a guiding column applied to guide directions, and a compression spring.

* * * * *